US009765645B2

(12) United States Patent
Fontanel et al.

(10) Patent No.: US 9,765,645 B2
(45) Date of Patent: Sep. 19, 2017

(54) JOURNAL FOR A TURBINE ENGINE COMPRISING A RING FOR RECOVERING A FLOW OF LUBRICATING OIL WITH A PLURALITY OF LUBRICATING OIL DISCHARGE PORTS

(71) Applicant: SNECMA, Paris (FR)

(72) Inventors: Eddy Stephane Joel Fontanel, Palaiseau (FR); Giuliana Elisa Rossi, Paris (FR); Philippe Pierre Vincent Bouiller, Samoreau (FR); Emmanuel Da Costa, Saint Maur des Fosses (FR); Julien Foll, Lucy (FR)

(73) Assignee: SNECMA, Paris (FR)

( * ) Notice: Subject to any disclaimer, the term of this patent is extended or adjusted under 35 U.S.C. 154(b) by 342 days.

(21) Appl. No.: 14/408,425

(22) PCT Filed: Jun. 12, 2013

(86) PCT No.: PCT/FR2013/051377

§ 371 (c)(1),
(2) Date: Dec. 16, 2014

(87) PCT Pub. No.: WO2014/001681

PCT Pub. Date: Jan. 3, 2014

(65) Prior Publication Data

US 2015/0147157 A1 May 28, 2015

(30) Foreign Application Priority Data

Jun. 28, 2012 (FR) ..... 12 56173

(51) Int. Cl.
*F01D 25/18* (2006.01)

(52) U.S. Cl.
CPC ..... *F01D 25/183* (2013.01); *F01D 25/18* (2013.01); *F05D 2260/6022* (2013.01)

(58) Field of Classification Search
CPC ..... F01D 25/125; F01D 25/18; F01D 25/183; F02C 7/06; F05D 2260/6022; F05D 2260/98
See application file for complete search history.

(56) References Cited

U.S. PATENT DOCUMENTS 5,114,446 A * 5/1992 Giersdorf ..... F01D 25/18 55/345
6,286,303 B1 * 9/2001 Pfligler ..... F01D 25/125 415/110

(Continued)

FOREIGN PATENT DOCUMENTS

DE 102013108668 A1 * 2/2015 ..... F01D 25/18
FR 2 918 120 A1 1/2009

(Continued)

OTHER PUBLICATIONS

Machine translation of FR 2,934,640; retrieved from Espacenet on Jan. 5, 2017.*

(Continued)

*Primary Examiner* — Dwayne J White
*Assistant Examiner* — Sang K Kim
(74) *Attorney, Agent, or Firm* — Oblon, McClelland, Maier & Neustadt, L.L.P.

(57) ABSTRACT

A journal configured to be driven in rotation in a housing of a turbine engine, or for an aircraft, the journal including: a circumferential main body including plural ventilation openings configured to allow plural axial airflows to circulate from upstream to downstream in the turbine engine, two consecutive ventilation openings being connected by a connecting segment, and a circumferential ring for recovering a flow of lubrication oil, which ring is rigidly connected to the main body and is radially inside the ventilation openings, the circumferential ring including plural radial discharge openings for allowing plural radial flows of oil to be discharged (Continued)

towards the outside, each discharge opening being radially aligned with a connecting segment of the main body to allow each flow of oil to be discharged radially between the airflows.

14 Claims, 4 Drawing Sheets

(56) References Cited

U.S. PATENT DOCUMENTS

| | | | | |
|---|---|---|---|---|
| 7,458,202 | B2 * | 12/2008 | Moniz | F01D 25/18 60/226.1 |
| 8,225,593 | B2 * | 7/2012 | Le Hong | F01D 25/16 60/268 |
| 2009/0000273 | A1 | 1/2009 | Le Hong et al. | |
| 2009/0199534 | A1 | 8/2009 | Bart et al. | |
| 2011/0188992 | A1 | 8/2011 | Fintescu et al. | |
| 2013/0280063 | A1 * | 10/2013 | Ganiger | F16C 19/54 415/229 |
| 2013/0283757 | A1 * | 10/2013 | Bordne | F02C 7/06 60/39.08 |
| 2015/0308344 | A1 * | 10/2015 | Vo | F01D 9/065 415/213.1 |

FOREIGN PATENT DOCUMENTS

| | | | | |
|---|---|---|---|---|
| FR | 2 090 764 | A1 | 8/2009 | |
| FR | 2 929 325 | A1 | 10/2009 | |
| FR | 2 934 640 | A1 | 2/2010 | |
| FR | 2934640 | A1 * | 2/2010 | F01D 25/162 |
| FR | 2 968 062 | A1 | 6/2012 | |
| FR | 3005099 | A1 * | 10/2014 | F01D 9/065 |

OTHER PUBLICATIONS

Machine translation of FR 3,005,099; retrieved from Espacenet on Jan. 5, 2017.*

Machine translation of DE 10 2013 108668; retrieved from ESpacenet on Jan. 5, 2017.*

International Search Report issued Jul. 25, 2013 in PCT/FR2013/051377 Filed Jun. 12, 2013.

* cited by examiner

JOURNAL FOR A TURBINE ENGINE COMPRISING A RING FOR RECOVERING A FLOW OF LUBRICATING OIL WITH A PLURALITY OF LUBRICATING OIL DISCHARGE PORTS

GENERAL TECHNICAL FIELD AND PRIOR ART

The present invention relates to the field of turbine engines, in particular for an aircraft, and aims to improve the circulation of lubrication oil and vent air in a turbine engine.

Conventionally, with reference to FIG. 1, a turbojet engine comprises a housing 1 in which one or more rotary bodies are mounted by means of bearings (not shown). A turbojet engine conventionally comprises an upstream compressor part, a combustion chamber and a downstream turbine part, an airflow F circulating from upstream to downstream in the turbojet engine. A turbojet engine of this type is known for example from FR 2944557 by SNECMA. The rotary bodies are equipped with radial blades both to allow the airflow F to be accelerated in the combustion chamber of the turbojet engine and to allow the combustion energy to be recovered. As shown in FIG. 1, the turbojet engine comprises a rotary body comprising a circumferential journal 2 connected upstream of a drum 3 by a bolted connection 4. In this example, the drum 3 corresponds to a low-pressure shaft of the turbojet engine. The journal 2 conventionally comprises a main body 20 which extends transversely to the axis of the turbojet engine and annular sealing parts 5, 6 which are attached to the upstream and downstream faces of the main body 20 respectively, as shown in FIG. 1. The annular sealing parts 5, 6 advantageously comprise sealing strips 50, 60 which cooperate with abradable elements 15, 16 which are rigidly connected to the housing 1 of the turbojet engine in order to form a sealed air duct in which the airflow F circulates. In order to allow the airflow F to circulate from upstream to downstream through the journal 2, said journal comprises angularly distributed ventilation openings 21 as shown in FIG. 1.

In addition, in order to allow the guide bearings of the rotary bodies to be lubricated and cooled, the turbojet engine conventionally comprises a lubricating circuit. The lubricating circuit is contained in a lubricating enclosure which is arranged within the air circulation duct. Under certain conditions, a flow of oil H may escape from the lubricating enclosure and penetrate the air duct, as shown in FIG. 1. Under the effect of centrifugal forces, the flow of oil H is radially projected so as to be received in a recovery passage 61 of the journal 2 before being drained upstream in order to be reintroduced into the lubricating circuit.

When the flow of oil H is projected radially through the air duct, it may meet the airflow F in a region of intersection Z, represented by a circle in FIG. 1. In this region Z, some of the flow of lubrication oil H may be carried downstream by the airflow F as far as a hot region of the turbojet engine in which the lubrication oil may ignite, which is a drawback.

BRIEF DESCRIPTION OF THE INVENTION

In order to limit this drawback, the invention relates to a journal capable of being driven in rotation in a housing of a turbine engine, in particular for an aircraft, the journal comprising:

a circumferential main body comprising a plurality of angularly distributed ventilation openings capable of allowing a plurality of axial airflows to circulate from upstream to downstream in the turbine engine, two consecutive ventilation openings being connected by a connecting segment, and a circumferential ring for recovering a flow of lubrication oil, which ring is rigidly connected to the main body and is radially inside said ventilation openings, the recovery ring extending longitudinally and comprising a plurality of radial discharge openings for allowing a plurality of radial flows of oil to be discharged towards the outside, each discharge opening being radially aligned with a connecting segment of the main body so as to allow each flow of oil to be discharged between the airflows.

Advantageously, the recovery ring allows any flow of oil escaping from a lubricating enclosure of the turbine engine to be collected in a circumferential manner. Furthermore, the discharge openings, which are carefully aligned with the connecting segments, allow the flow of oil to be prevented from being carried in the downstream direction by the airflows, and this is advantageous. Such a journal has a simple structure and may advantageously be installed in place of a journal according to the prior art.

Preferably, at least one connecting segment that is radially aligned with a discharge opening of the recovery ring comprises means for guiding a radial flow of oil. More preferably, the guide means are in the form of a radial groove. The guide means allow the flow of oil to be channelled when it is radially displaced so as to prevent it from penetrating into the ventilation openings. A radial groove is simple to implement and allows a passage to be formed which limits any dispersion of oil.

According to a preferred aspect, the guide means are in the form of a guide channel so as to prevent the flows of oil from circulating close to the ventilation openings. Preferably, the guide channel has a U-shaped cross section so that the lateral edges of the guide channel obstruct any circulation of the flows of oil towards the ventilation openings.

It goes without saying that the guide channels may be closed and may have a circular or flattened cross section.

Preferably, the guide means, preferably a guide channel, are connected to the connecting segment in order to prevent the main body of the journal from wearing, which is likely to reduce the service life thereof. Such an embodiment is advantageous for elongate ventilation openings, preferably those that are oblong.

More preferably, the guide means, in particular a guide channel, are rigidly connected to the circumferential ring so as to facilitate the assembly of the journal and the precise positioning of the guide means relative to the discharge openings in the circumferential ring.

Still preferably, the journal comprises a circumferential passage for recovering the flows of lubrication oil that are radially on the outside of said ventilation openings. A recovery passage of this type advantageously allows the oil which has passed between the ventilation openings to be recovered. Once stored in the passage, the lubrication oil may be conducted to the desired location, for example into a circuit for draining lubrication oil.

Preferably, the recovery passage comprises means for draining the flow of lubrication oil. Preferably, the drainage means are drainage openings, which preferably discharge into a circuit for draining lubrication oil.

According to a preferred aspect of the invention, since the journal comprises radial sealing strips capable of cooperating with an abradable element of the housing of the turbine engine, the recovery ring is radially on the outside of said sealing strips. Therefore, any overflow of oil from the sealing strips is projected radially outwards under the effect of the centrifugal forces in order to be caught by the recovery ring.

Preferably, the recovery ring extends longitudinally as far as the right of the sealing strips. Therefore, the length of the ring is adapted for collecting the flow of oil escaping from the sealing strips, while being of a reduced length to limit the mass thereof.

Preferably, the recovery ring extends longitudinally in the downstream direction from the main body of the journal.

According to one aspect of the invention, the journal comprises a circumferential auxiliary body having a U-shaped cross section so as to define a base that is in planar contact with the main body, a radially upper branch forming the recovery ring and a radially lower branch on which radial sealing strips are formed which are capable of cooperating with an abradable element of the housing of the turbine engine. Advantageously, the auxiliary body allows any leaks of lubrication oil to be collected.

Preferably, the main body and the auxiliary body are interconnected by a plurality of bolted connections so as to facilitate assembly and maintenance.

The invention also relates to a turbine engine, in particular for an aircraft, comprising a housing and an axial body that is rotatably mounted in the housing, the rotary body comprising a journal as described above.

DESCRIPTION OF THE DRAWINGS

The invention will be better understood upon reading the following description, given purely by way of example, and with reference to the accompanying drawings, in which.

It should be noted that the drawings disclose the invention in a detailed manner in order to carry out the invention, and said drawings can of course serve to give a better definition of the invention where appropriate.

DESCRIPTION OF ONE OR MORE EMBODIMENTS

Figure 1:
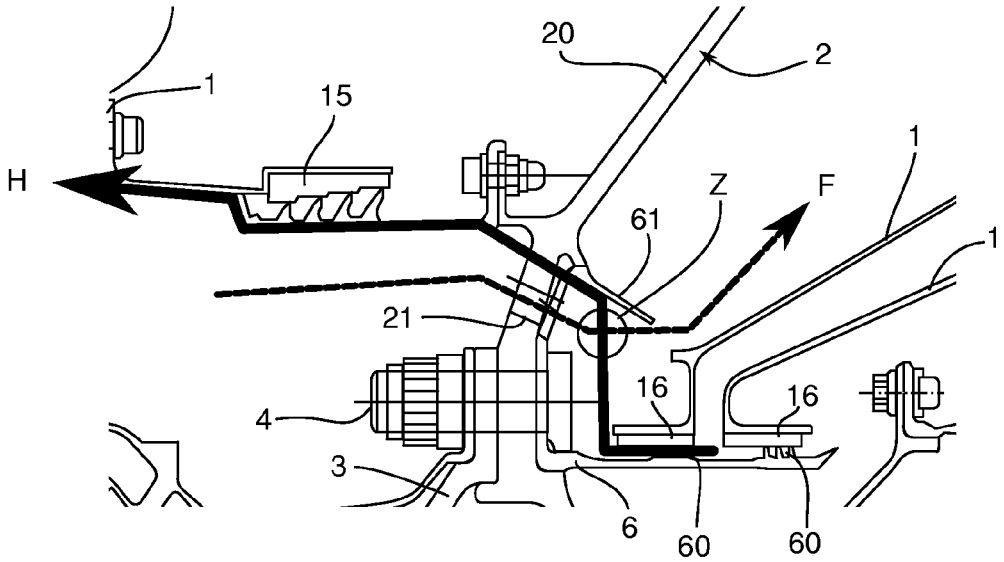
Figure 1 Background Art
FIG. 1 is a longitudinal section through a turbine engine according to the prior art.
Figure 2:
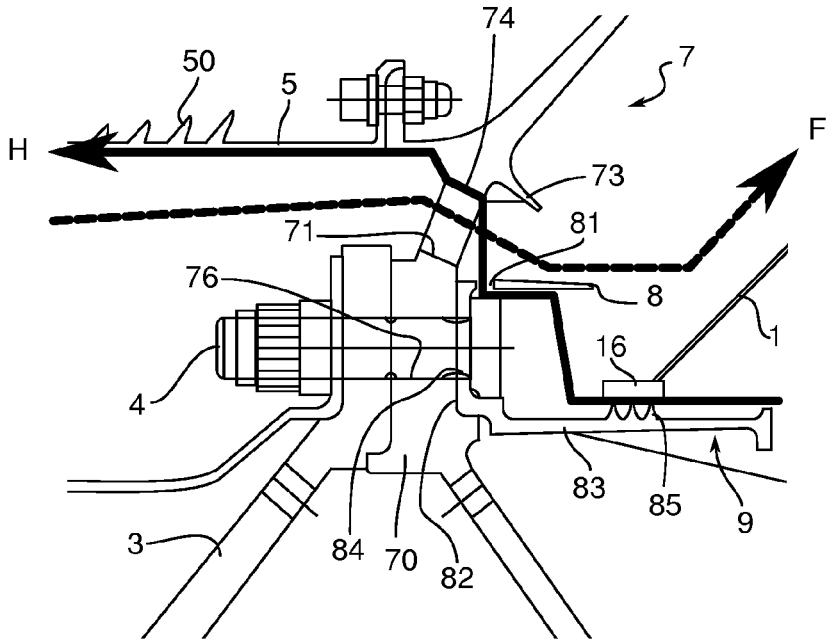
FIG. 2 is a longitudinal section through a turbine engine comprising a journal according to the invention.

With reference to FIG. 2, which shows a turbojet engine according to the invention, said engine comprises a housing 1 in which a high-pressure rotary body and a low-pressure rotary body are mounted by means of bearings (not shown). In this example, the turbojet engine comprises an upstream compressor part, a combustion chamber and a downstream turbine part, an airflow F circulating from upstream to downstream in the turbojet engine.

The rotary bodies are equipped with radial blades both to allow the airflow F to be accelerated in the combustion chamber of the turbojet engine and to allow the combustion energy to be recovered. As shown in FIG. 2, the turbojet engine comprises a low-pressure rotary body comprising a circumferential journal 7 which extends longitudinally to an axis X-X and is connected upstream to an axial drum 3 by a plurality of bolted connections 4.

Still with reference to FIG. 2, the journal 7 comprises a main body 70 which extends substantially longitudinally to the axis X-X and an upstream annular sealing part 5 which is attached to the upstream face of the main body 70, as shown in FIG. 2. The upstream annular sealing part 5 advantageously comprises sealing strips 50 which are capable of cooperating with abradable elements 15 which are rigidly connected to the housing 1 of the turbojet engine in order to form a sealed air duct in which the airflow F circulates.

Figure 3:
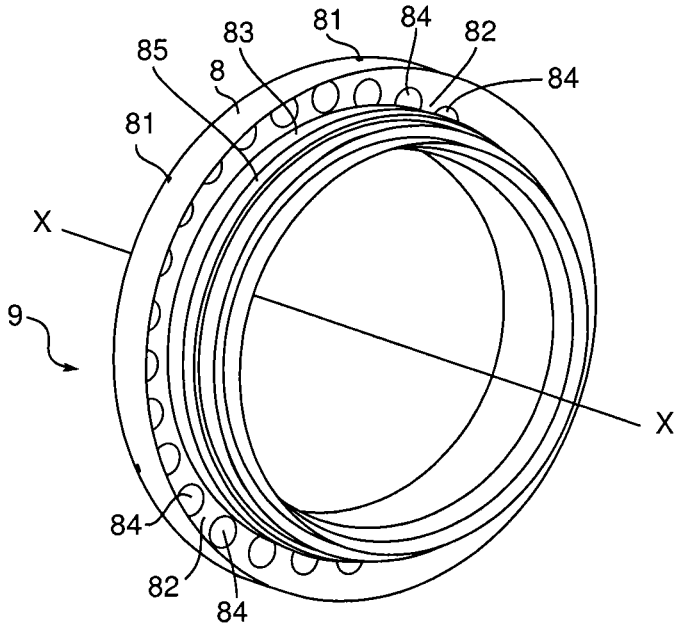
FIG. 3 is a schematic view of the circumferential auxiliary body of the journal from FIG. 2.
Figure 4:
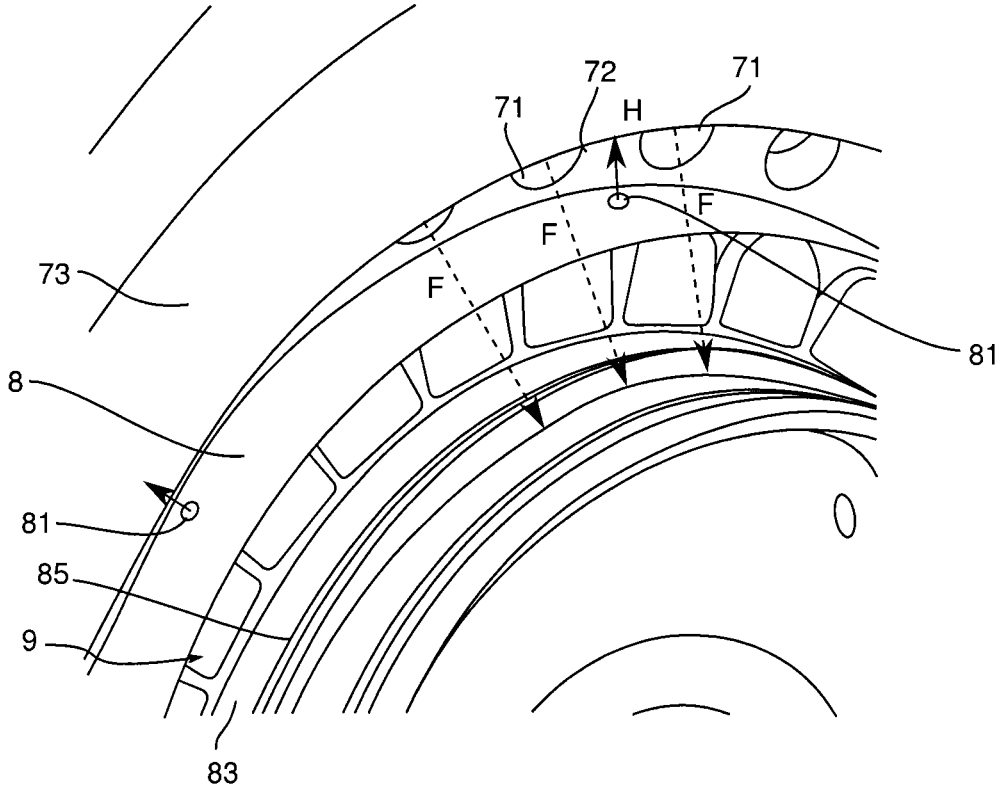
FIG. 4 is an enlarged schematic view of the circulation of the flow of oil and of the airflow for the journal from FIG. 2.

The main body 70 of the journal 7 extends substantially in a radial plane and comprises a plurality of ventilation openings 71 distributed angularly and circumferentially over the main body 70 so as to allow the axial airflow F to circulate from upstream to downstream through the journal 7, as shown in FIGS. 2 to 4. As shown in FIG. 4, two consecutive ventilation openings 71 are connected by a connecting segment 72 which extends in a plane that is substantially transverse to the axis X-X of the journal 7. In this example, a flow of oil H may circulate on the downstream face of the journal 7.

The main body 70 further comprises a plurality of axial attachment openings 76 distributed angularly and circumferentially over the main body 70 in order to allow attachment screws to pass through to rigidly connect the drum 3 to the journal 7 by means of bolted connections 4. In this example, the axial attachment openings 76 in the journal 7 are positioned radially on the inside of the ventilation openings 71, as shown in FIG. 2.

In this example, with reference to FIGS. 2 to 4, the journal 7 comprises a circumferential auxiliary body 9 having a U-shaped cross section so as to define a base 82 that is in planar contact with the main body 70, a radially upper branch forming a recovery ring 8 and a radially lower branch 83 on which radial sealing strips 85 are formed which are capable of cooperating with an abradable element 16 of the housing 1 of the turbine engine.

The base 82 of the auxiliary body 9 extends radially and comprises a plurality of axial attachment openings 84 distributed angularly and circumferentially in order to allow attachment screws to pass through to rigidly connect the drum 3, the journal 7 and the auxiliary body 9 by means of bolted connections 4.

As shown in FIGS. 2 and 3, the radially upper branch 8 of the auxiliary body 9 extends longitudinally, that is to say orthogonally, to the main body 70 and has a length that is less than that of the radially lower branch 83. The radially upper branch 8 forms a recovery ring 8 which extends to the right of the sealing strips 85, which in turn extend radially outwards from the radially lower branch 83 in order to collect any flows of oil H escaping via the sealing strips 85 under the effect of the centrifugal forces, as shown in FIG. 4.

The recovery ring 8 comprises a plurality of radial discharge openings 81 to allow a plurality of radial flows of oil H to be discharged towards the outside. The discharge openings 81 are angularly and circumferentially distributed in order to allow the flow of lubrication oil H to be homogenously discharged. According to the invention, as shown in FIG. 4, each discharge opening 81 is radially aligned with a connecting segment 72 of the main body 70 so as to allow each flow of oil H to be discharged between the airflows F. Therefore, contrary to the prior art, there is no region in which the airflows F and the flows of oil H meet, thereby limiting the risk of a flow of oil H being carried along with the airflow F downstream of the turbojet engine.

In this example, the number of discharge openings 81 is less than the number of connecting segments 72, preferably three times less.

Preferably, with reference to FIG. 2, the main body 70 of the journal 7 comprises a circumferential passage 73 for recovering the flows of lubrication oil H that are radially on the outside of said ventilation openings 71. Once in contact with the walls of the recovery passage 73, the flow of lubrication oil H is less likely to be disrupted by the airflows F. Still preferably, the recovery passage 73 comprises means 74 for draining the flow of lubrication oil which are, for example, in the form of radial or oblique openings.

According to a preferred embodiment, at least one connecting segment 72 comprises means for guiding a radial flow of oil H in order to allow the flow of oil H to be transported from the discharge openings 81 in the ring 8 to the recovery passage 73. By way of example, the guide means are in the form of a radial groove or a radial channel.

When the turbojet engine is in operation, with reference to FIG. 4, airflows F circulate from upstream to downstream through the ventilation openings 71 in the journal 7. In other words, the airflows F, which pass through the journal 7, are separated from each other given that the connecting segments 72 prevent the airflow F from circulating. When a flow of oil H escapes from the lubricating circuit of the turbojet engine via the sealing strips 85, the flow of oil H is radially ejected towards the outside owing to the centrifugal forces in the recovery ring 8 which extends to the right of the sealing strips 85. Therefore, the lubrication oil H is circumferentially recovered by the recovery ring 8 which temporarily stores the lubrication oil H in order to radially discharge it towards the outside as far as the recovery passage 73 of the journal 7.

In order to prevent the flow of oil H and the airflows F from meeting, the flow of oil H that is stored temporarily by the recovery ring 8 is discharged in a plurality of elementary flows of oil H via the discharge openings 81 which are each aligned with connecting segments 72 of the main body 70. As shown in FIG. 4, each radial flow of oil H moves towards the outside between two axial airflows F while being protected by the connecting segments 72. Therefore, there is no risk of the oil being carried by the axial airflows F downstream of the turbojet engine.

A journal 7 having a main body 70 that is separate from the auxiliary body 9 has been set out, but it goes without saying that the invention also applies to a journal comprising a main body and an auxiliary body forming a single-piece assembly.

A second embodiment of the invention is described with reference to FIGS. 5 to 8. The reference signs used to describe the elements having an identical, equivalent or similar structure or function to those of the elements of FIG. 2 are the same, in order to simplify the description. Moreover, not all of the description of the embodiment in FIG. 2 is reproduced, this description applying to the elements of FIGS. 5 to 8 when these are consistent. Only the significant structural and functional differences are described.

Figure 5:
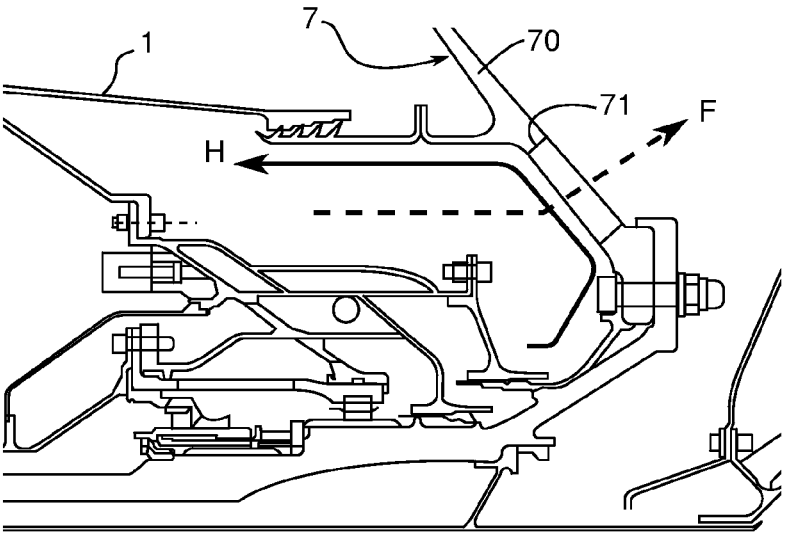
Figure 5 Background Art
FIG. 5 is a longitudinal section through a turbine engine according to the prior art.
Figure 6:
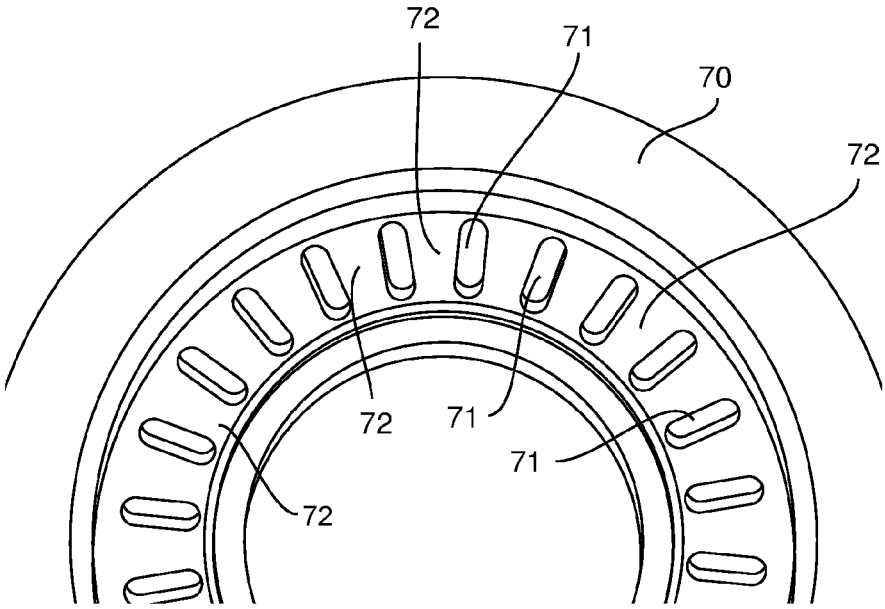
Figure 6 Background Art
FIG. 6 is a perspective view of a journal according to the prior art.
Figure 7:
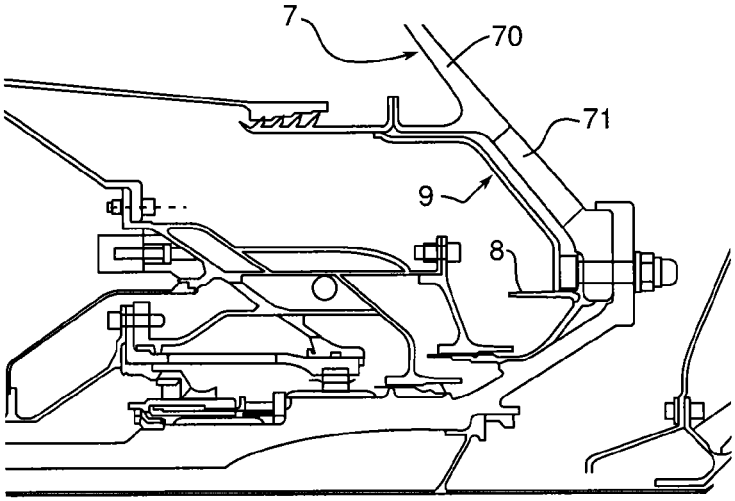
FIG. 7 is a longitudinal section through a turbine engine according to the invention.

With reference to FIGS. 5 to 7, the journal 7 comprises a main body 70 which extends obliquely to a radial plane and comprises a plurality of ventilation openings 71 that are distributed angularly and circumferentially over the main body 70 so as to allow the axial air flow F to circulate from upstream to downstream through the journal 7, as shown in FIG. 5. In this example, a flow of oil H is likely to circulate on the upstream face of the journal 5.

As shown in FIG. 6, two consecutive ventilation openings 71 of the main body 70 are connected by a connecting segment 72. In this second embodiment, the ventilation openings 71 are oblong, the length of which extends radially, as shown in FIG. 6, so as to increase the airflow rate.

Figure 8:
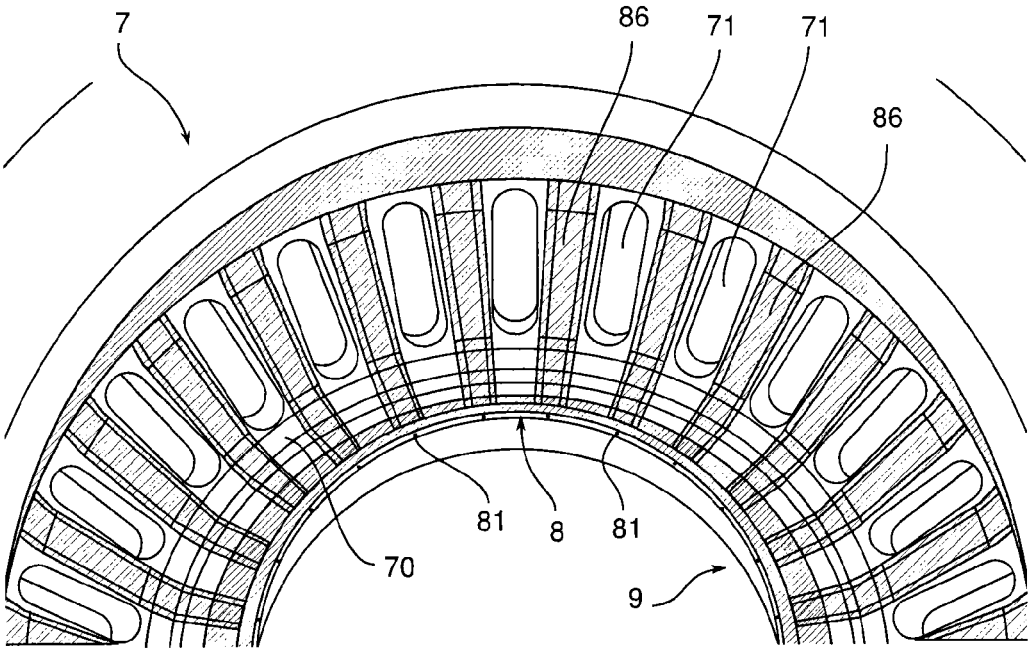
FIG. 8 is a perspective view of a journal according to the invention.

In a similar manner to the first embodiment, with reference to FIGS. 4 and 8, the journal 7 comprises a circumferential auxiliary body 9 comprising a recovery ring 8 which comprises a plurality of radial discharge openings 81 to allow a plurality of radial flows of oil H to be discharged towards the outside, as shown in FIG. 4. The discharge openings 81 are angularly and circumferentially distributed in order to allow the flow of lubrication oil H to be homogenously discharged.

Still with reference to FIG. 4, each discharge opening 81 is radially aligned with a connecting segment 72 of the main body 70 so as to allow each flow of oil H to be discharged between the airflows F, that is to say between the ventilation openings 71. In this embodiment, the oblong ventilation openings 71 disrupt the circulation of the flow of oil H on the connecting segments 72, it being possible for the flow of oil H to be diverted from its radial circulation direction.

For this purpose, as set out above, at least one connecting segment 72 comprises means for guiding a radial flow of oil H in order to prevent any diversion along the oblong ventilation openings 71.

In this example, with reference to FIG. 8, the circumferential auxiliary body 9 comprises a plurality of guide channels 86 which are mounted on the connecting segments 72 opposite the discharge openings 81. Each guide channel 86 extends along the connecting segment 72 on which it is intended to be mounted, the cross section of a guide channel preferably being U-shaped so as to prevent any diversion of the flow of oil H when it is circulating between consecutive ventilation openings 71, in particular when they are oblong. In this example, the discharge openings 81 discharge opposite the base of the U-shape of the guide channels 86 so that the branches of the U-shape prevent any circulation of a flow of oil in the adjacent ventilation openings 71, as shown in FIG. 8.

Alternatively, the guide channels 86 may be closed and may have a circular or flattened cross section.

Preferably, with reference to FIG. 8, the circumferential ring 8 and the guide channels 86 are rigidly connected by welding. The auxiliary body 9 may thus be mounted simply and rapidly on the main body 70 of the journal 7. In addition, the discharge openings 81 are precisely aligned with the guide channels 86 since they are rigidly connected to circumferential ring 8, and this is advantageous.

The use of guide channels 86 added to the journal 7 is more advantageous than forming channels in the main body 70 of the journal 7, given that machining may weaken the structure of the journal 7. Such an embodiment is particularly advantageous if the ventilation openings 71 are elongate.

The invention claimed is:

1. A journal configured to be driven in rotation in a housing of a turbine engine, or for an aircraft, the journal comprising:

a circumferential main body comprising a plurality of angularly distributed ventilation openings configured to allow a plurality of axial airflows to circulate from upstream to downstream in the turbine engine, two consecutive ventilation openings being connected by a connecting segment; and a circumferential ring for recovering a flow of lubrication oil, which ring is rigidly connected to the main body and is radially inside the ventilation openings, the circumferential ring extending longitudinally and comprising a plurality of radial discharge openings for allowing a plurality of radial flows of oil to be discharged towards an outside, of the circumferential ring;

wherein each discharge opening is radially aligned with a connecting segment of the main body to allow each flow of oil to be discharged radially between the airflows.

2. A journal according to claim 1, wherein at least one connecting segment that is radially aligned with a discharge opening of the circumferential ring comprises guide means for guiding a radial flow of oil.

3. A journal according to claim 2, wherein the guide means is in a form of a radial groove.

4. A journal according to claim 2, wherein the guide means is in a form of a guide channel.

5. A journal according to claim 4, wherein the guide channel has a U-shaped cross section.

6. A journal according to claim 4, wherein the guide channel is added to the connecting segment.

7. A journal according to claim 4, wherein the guide channel is rigidly connected to the circumferential ring.

8. A journal according to claim 1, further comprising a circumferential recovery passage for recovering the flows of lubrication oil that are radially on an outside of the ventilation openings.

9. A journal according to claim 8, wherein the recovery passage comprises means for draining the flow of lubrication oil.

10. A journal according to claim 1, further comprising radial sealing strips configured to cooperate with an abradable element of the housing of the turbine engine, the circumferential ring being radially on an outside of the sealing strips.

11. A journal according to claim 10, wherein the circumferential ring extends longitudinally up to the sealing strips.

12. A journal according to claim 1, wherein the circumferential ring extends longitudinally in a downstream direction from the main body of the journal.

13. A journal according to claim 1, further comprising a circumferential auxiliary body having a U-shaped cross section to define a base that is in planar contact with the main body, a radially upper branch forming the circumferential ring and a radially lower branch on which radial sealing strips are formed which are configured to cooperate with an abradable element of the housing of the turbine engine.

14. A turbine engine, or for an aircraft, comprising a housing and an axial body that is rotatably mounted in the housing, the axial body comprising a journal according to claim 1.

* * * * *